US006032556A

United States Patent [19]

Hu

[11] Patent Number: 6,032,556

[45] Date of Patent: Mar. 7, 2000

[54] HEX WRENCH

[76] Inventor: Bobby Hu, 8F, No. 536-1, Ta Chin Street, Taichung, Taiwan

[21] Appl. No.: 09/223,034

[22] Filed: Jan. 1, 1999

[51] Int. Cl.[7] ..... B25B 13/48

[52] U.S. Cl. ..... 81/436

[58] Field of Search ..... 81/436, 460

[56] References Cited

U.S. PATENT DOCUMENTS

| | | | |
|---|---|---|---|
| 4,246,811 | 1/1981 | Bondhus et al. | 81/436 |
| 4,367,664 | 1/1983 | Ekshtut | 81/436 |
| 5,140,877 | 8/1992 | Sloan | 81/439 |
| 5,251,521 | 10/1993 | Burda et al. | 81/460 |
| 5,370,021 | 12/1994 | Shigmatsu | 81/436 |
| 5,408,905 | 4/1995 | Mikic et al. | 81/436 |

*Primary Examiner*—James G. Smith
*Assistant Examiner*—Lee Wilson
*Attorney, Agent, or Firm*—Alan Kamrath; Oppenheimer

[57] ABSTRACT

A hex wrench is provided for driving a screw having a screw head with a counterbore defined therein. The hex wrench is L-shaped and includes a longer section and a shorter section. The longer section includes a neck defined therein, thereby forming a distal driving end with an end face. The neck includes an end edge that faces the driving end. A distance between the end edge of the neck and the end face of the driving end is smaller than a radius of the screw to be driven. The end edge of the neck bears against the screw head when the driving end is received in the counterbore of the screw head in a slanted manner for driving the screw. A portion of the longer section above the neck is engaged with the counterbore of the screw head when the driving end is received in the counterbore in an upright manner.

2 Claims, 6 Drawing Sheets

HEX WRENCH

BACKGROUND OF THE INVENTION

1. Field of the Invention

The present invention relates to a hex wrench that includes a driving end for high torque operation.

2. Description of the Related Art

A typical hex wrench is substantially L-shaped and includes a longer section and a shorter section. FIG. 9 of the drawings illustrates a hex wrench 1 that has an end engaged in a counterbore 3 of a screw head 2. The hex wrench 1 has a relatively long contact length "X" with the counterbore 3 to allow high-torque operation. Nevertheless, in some cases, the screw to be driven is located in a limited space that is difficult to access. The hex wrench usually has to be operated in a slanted manner. Referring to FIGS. 10 and 11, a hex wrench 4 with a ball-like driving end 5 formed on a longer section thereof is proposed to allow the driving end 5 to be received in the counterbore 3 of the screw head 2 in either a slanted manner or an upright manner. It is, however, found that the effective contact length between the driving end 5 and the screw head 2 is reduced to "B", which is much smaller than "X". As a result, high-torque operation cannot be provided. If the driving end 5 is formed on the shorter section of the hex wrench, it cannot be used in a limited space. Thus, the users has to carry two sets of hex wrenches: one set of normal hex wrenches for high-torque operation, and the other set of hex wrenches with ball-like driving ends for use in limited space, yet the use and carriage are both inconvenient. The present invention is intended to provide an improved hex wrench to solve these problems.

SUMMARY OF THE INVENTION

In accordance with the present invention, a hex wrench is provided for driving a screw having a screw head with a counterbore defined therein. The hex wrench is L-shaped and comprises a longer section and a shorter section. The longer section includes a neck defined therein, thereby forming a distal driving end with an end face. The neck includes an end edge that faces the driving end. A distance between the end edge of the neck and the end face of the driving end is smaller than a radius of the screw to be driven. The end edge of the neck bears against the screw head when the driving end is received in the counterbore of the screw head in a slanted manner for driving the screw. A portion of the longer section above the neck is engaged with the counterbore of the screw head when the driving end is received in the counterbore in an upright manner.

The driving end includes six convex sides, and the end face of the driving end includes six beveled surfaces that are respectively connected with the six convex sides of the driving end.

The hex wrench of the present invention can be used in either an upright manner or a slanted manner to allow high-torque operation. The hex wrench can be used in normal situations where high-torque driving is required in addition to the slanted use in limited spaces. The driving torque of the hex wrench is higher than that provided by conventional hex wrenches with ball-like driving ends.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
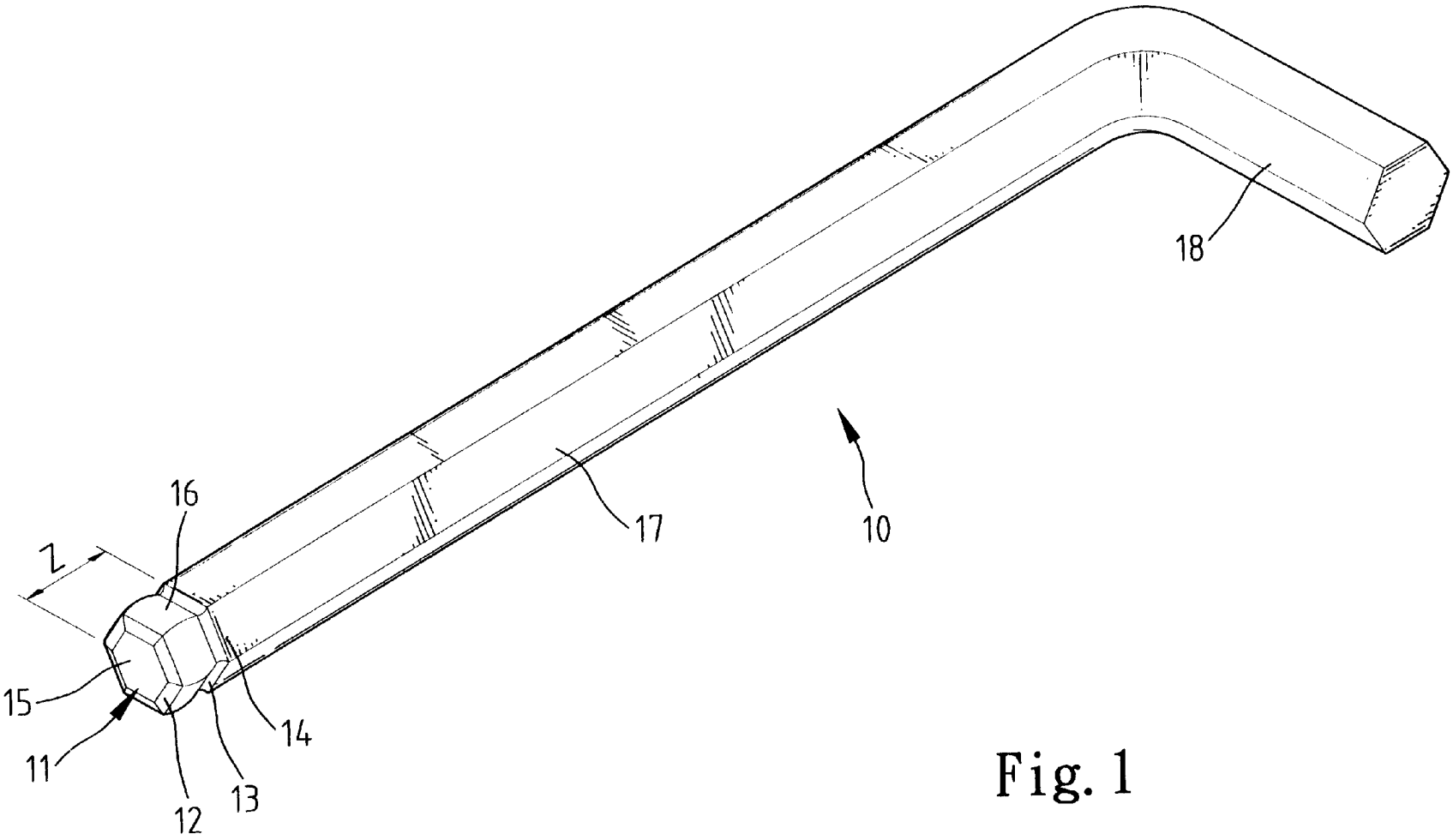
FIG. 1 is a perspective view of a hex wrench in accordance with the present invention.
Figure 2:
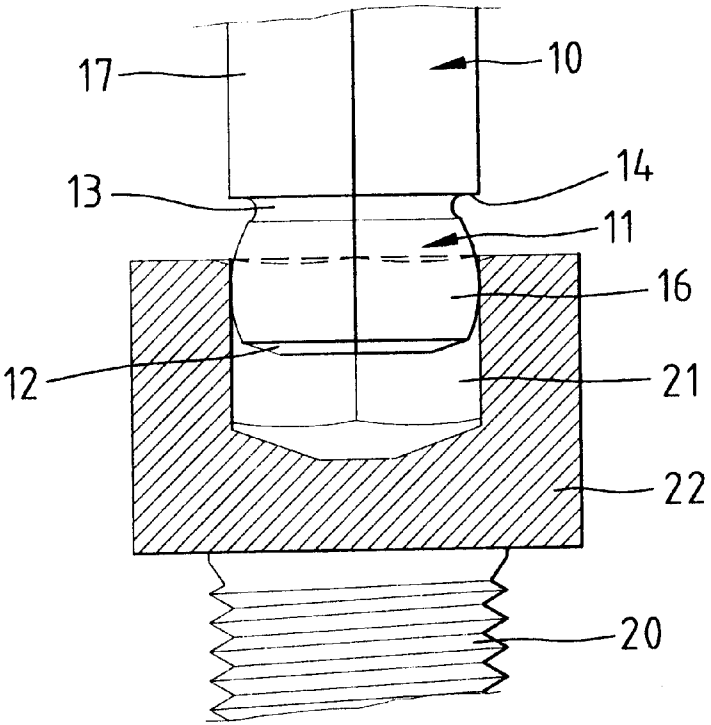
FIG. 2 is a side view, partially sectioned, illustrating an upright engagement of a driving end of the hex wrench into a counterbore of a screw head.

Referring to FIGS. 1 to 8 and initially to FIGS. 1 and 2, a hex wrench 10 in accordance with the present invention is provided for driving a screw 20 that has a screw head 22 with a counterbore 21 defined therein. The hex wrench 10 is L-shaped and comprises a longer section 17 and a shorter section 18. The longer section 17 including a neck 13 defined therein, thereby forming a distal driving end 11 with an end face 15. The driving end 11 includes six convex sides 16, and the end face 15 includes six beveled surfaces 12 that are respectively connected with the six convex sides 16 of the driving end 11.

Figure 4:
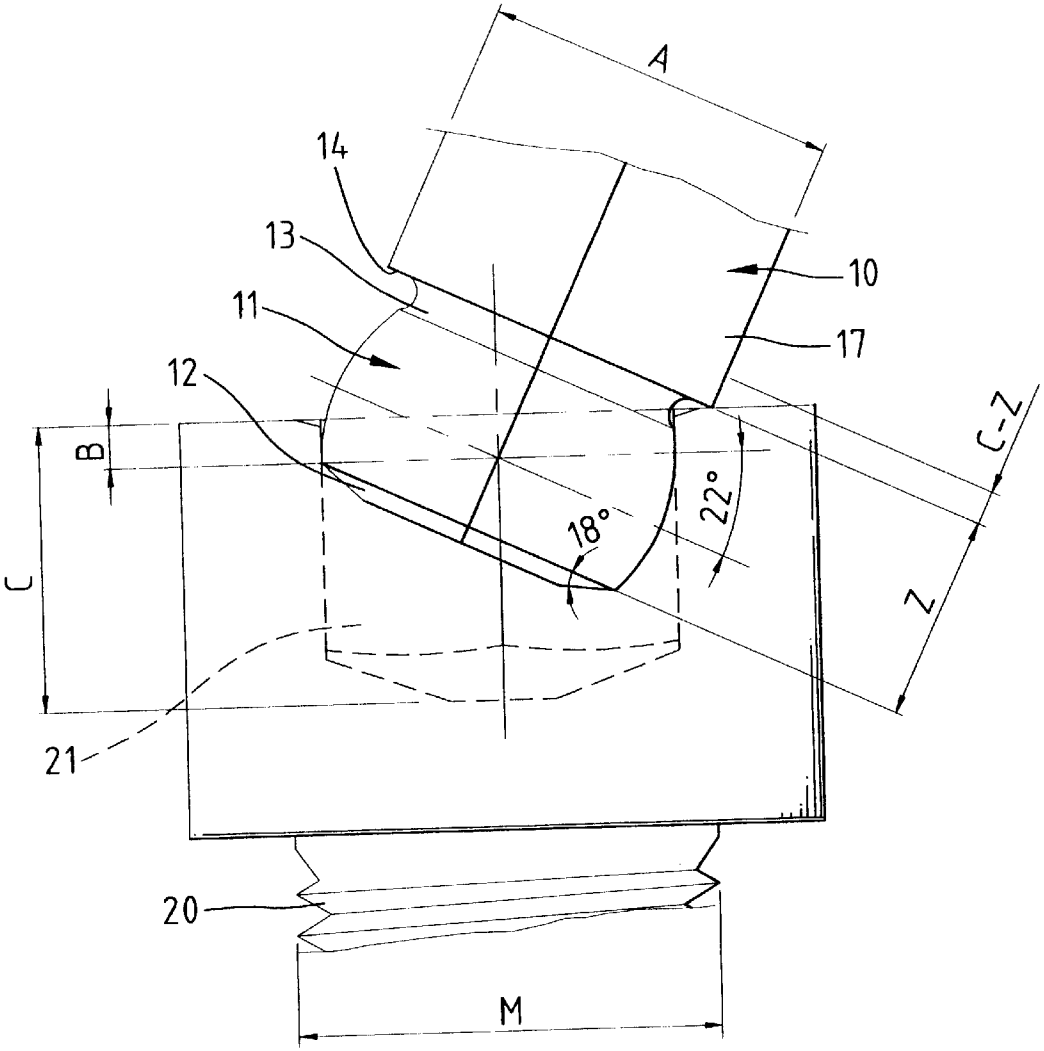
FIG. 4 is a side view illustrating a slant engagement of the driving end of the hex wrench into a counterbore of the screw head.

The neck 13 includes an end edge 14 that faces the driving end 11. Referring to FIG. 4, a distance "Z" (the effective distance of the drive end 11) between the end edge 14 of the neck 13 and the end face 15 (i.e., the beveled surface 12) of the driving end 11 is smaller than a radius (M/2) of the screw 20 to be driven. Table 1 shows corresponding sizes of the screws to be driven and the hex wrenches to be used.

TABLE 1

| M (mm) | A (mm) | C (mm) | Dt (mm) | Da (mm) | Z (mm) | C–Z (mm) | B (mm) |
|---|---|---|---|---|---|---|---|
| 12 | 10 | 6.5 | 6 | 7.0 | 5.19 | 1.31 | 1.23 |
| 10 | 8 | 5.5 | 5 | 6.3 | 4.14 | 1.36 | 0.98 |
| 8 | 6 | 4.5 | 4 | 4.5 | 3.11 | 1.39 | 0.74 |
| 6 | 5 | 3.5 | 3 | 3.5 | 2.59 | 0.91 | 0.61 |
| 5 | 4 | 3.0 | 2.5 | 2.8 | 2.09 | 0.91 | 0.49 |
| 4 | 3 | 2.5 | 2 | 2.6 | 1.57 | 0.93 | 0.37 |
| 3 | 2.5 | 2.0 | 1.5 | 2.0 | 1.31 | 0.69 | 0.31 |

wherein: M is the diameter of the screw 20; A is the distance between two mutually facing sides of the hex wrench 10; C is the depth of the counterbore 21; Dt is the theoretical counterbore depth; Da is the actual counterbore depth; Z is the effective distance of the drive end 11; C-Z (FIGS. 7 and 8) is an engaging length between a portion 19 of the longer section 17 and the counterbore wall; and B (FIGS. 5–8) is the maximum contact length between the driving end 11 and the counterbore wall. It is appreciated that in all cases the effective distance "Z" between the end edge 14 of the neck 13 and the end face 15 (i.e., the beveled surface 12) of the driving end 11 is smaller than a radius (M/2) of the screw 20 to be driven.

Figure 3:
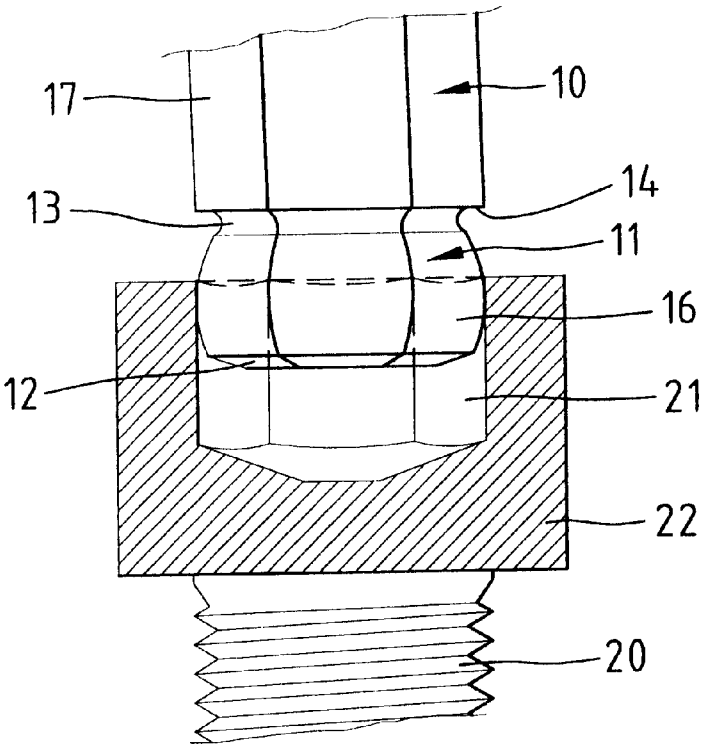
FIG. 3 is a side view similar from FIG. 2, in which the hex wrench is viewed from another direction.
Figure 6:
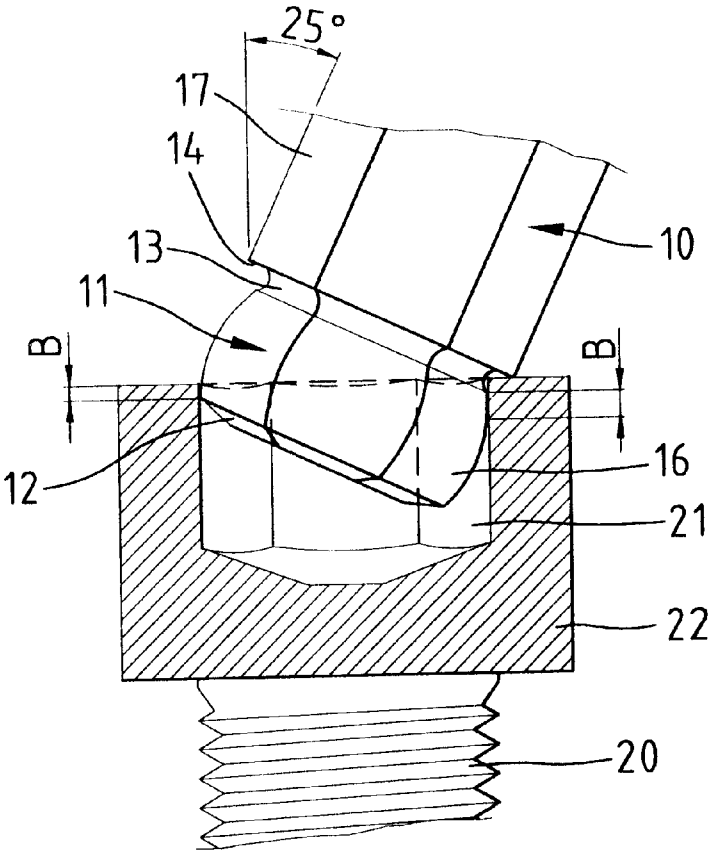
FIG. 6 is a side view similar to FIG. 5, wherein the hex wrench is viewed from another direction.
Figure 5:
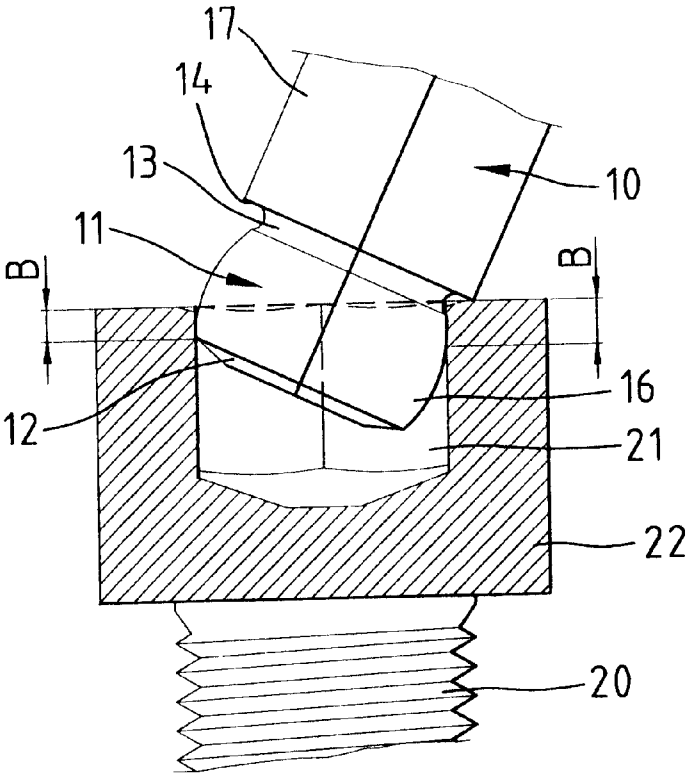
FIG. 5 is a reduced side view similar to FIG. 4, wherein the screw head is sectioned.

FIGS. 2 and 3 illustrates insertion of the driving end 11 of the hex wrench 10 into the counterbore 21 of the screw 20 to be driven. FIGS. 5 and 6 illustrates slant insertion of the driving end 11 of the hex wrench 10 into the counterbore 21 of the screw 20 to be driven. It is appreciated that the end edge 14 of the neck 13 bears against the screw head 22 when the driving end 11 is received in the counterbore 21 of the screw head 22 in a slanted manner for driving the screw 20. In addition, an inner peripheral upper edge (not labeled) of the screw head 22 bears against the neck 13 to provide a reliable engaging effect for driving the screw 20. This means that the driving torque of the hex wrench 10 is higher than that provided by conventional hex wrenches with ball-like driving ends (see the effective distance "Z" in FIG. 4).

Figure 8:
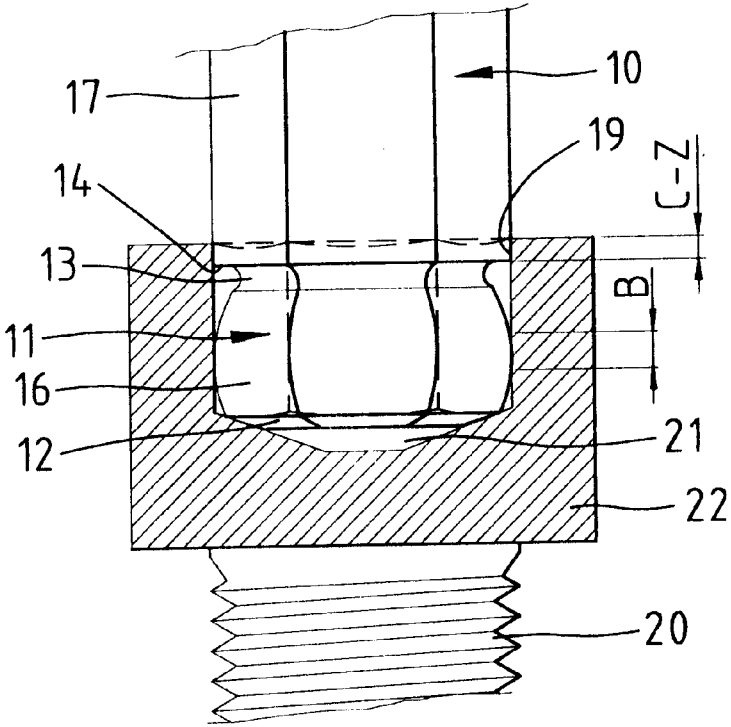
FIG. 8 is a side view similar to FIG. 7, wherein the hex wrench is viewed from another direction.
Figure 7:
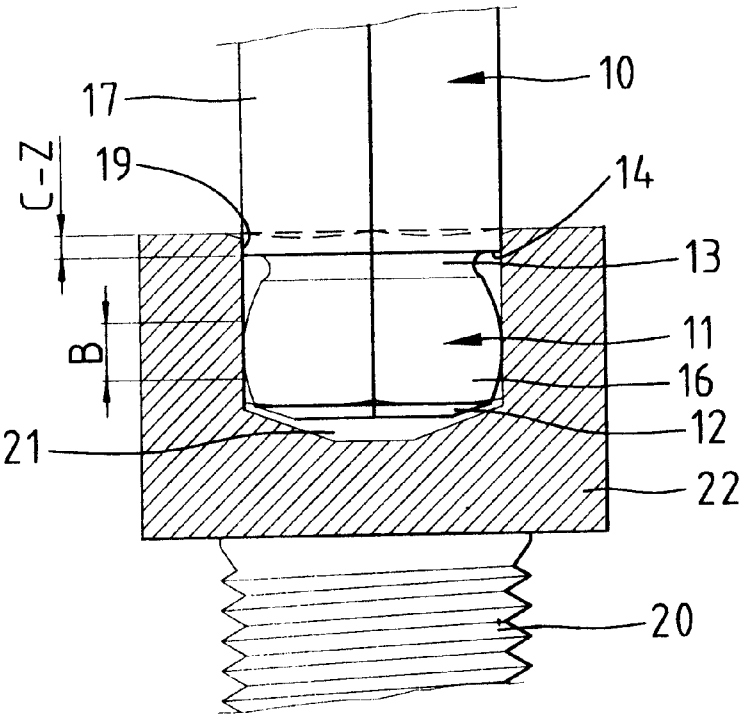
FIG. 7 is a side view, partially sectioned, of the driving end of the hex wrench completely received in the counterbore of the screw head.
Figure 11:
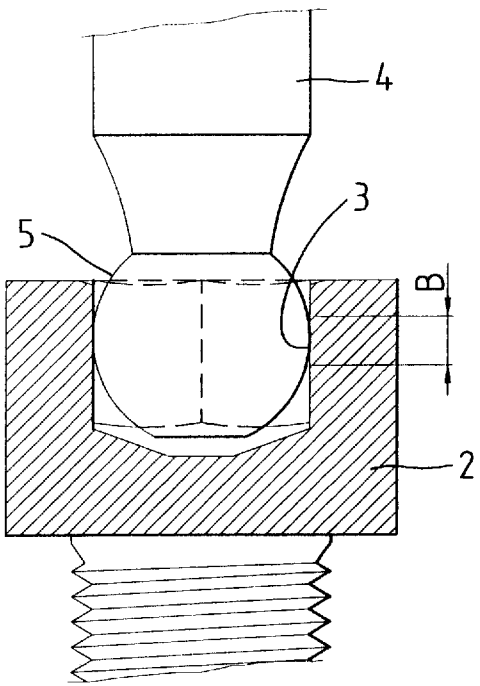
Fig. 11 PRIOR ART
FIG. 11 is a side view, partially sectioned, of a ball-like driving end of a conventional hex wrench engaged with a counterbore of a screw head in an upright manner.
Figure 10:
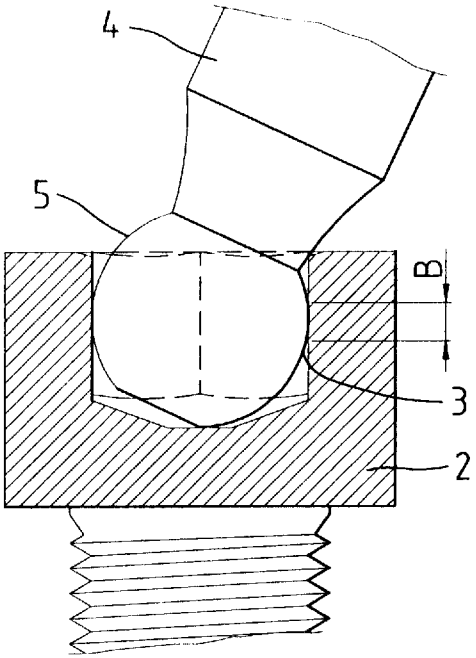
Fig. 10 PRIOR ART
FIG. 10 is a side view, partially sectioned, of a ball-like driving end of a conventional hex wrench engaged with a counterbore of a screw head in a slanted manner.
Figure 9:
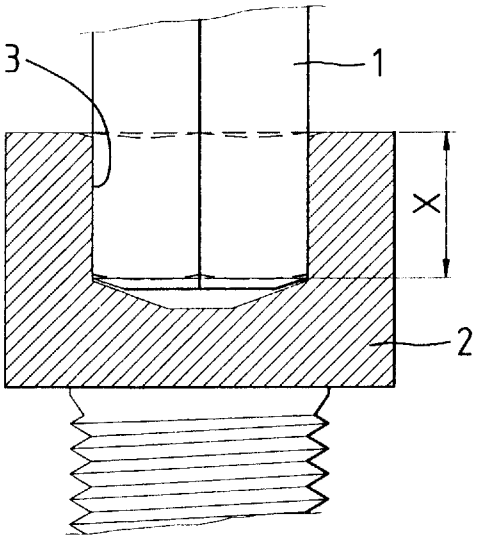
Fig. 9 PRIOR ART
FIG. 9 is a side view, partially sectioned, of a portion of a conventional hex wrench engaged with a counterbore of a screw head.

Referring to FIGS. 7 and 8, a portion 19 of the longer section 17 above the neck 13 is engaged with the counterbore 21 of the screw head 22 when the driving end 11 is received in the counterbore 21 in an upright manner. It is appreciated that high torque operation can be provided by the hex wrench 10 of the present invention, as the overall contact length between the hex wrench 10 is increased by an amount of "C-Z" when compared to the conventional hex wrench 4 with a ball-like driving end shown in FIG. 11.

According to the above description, it is appreciated that the hex wrench of the present invention can be used in either an upright manner or a slanted manner to allow high-torque operation. The hex wrench can be used in normal situations where high-torque driving is required in addition to the slanted use in limited spaces. The driving torque of the hex wrench is higher than that provided by conventional hex wrenches with ball-like driving ends.

Although the invention has been explained in relation to its preferred embodiment, it is to be understood that many other possible modifications and variations can be made without departing from the spirit and scope of the invention as hereinafter claimed.

What is claimed is:

1. A hex wrench for driving a screw having a screw head with a counterbore defined therein, the hex wrench being L-shaped and comprising a longer section and a shorter section, the longer section including a neck defined therein, thereby forming a distal driving end with an end face, the neck including an end edge that faces the driving end, a distance between the end edge of the neck and the end face of the driving end being smaller than a radius of the screw to be driven, the end edge of the neck bearing against the screw head when the driving end is received in the counterbore of the screw head in a slanted manner for driving the screw, a portion of the longer section above the neck being engaged with the counterbore of the screw head when the driving end is received in the counterbore in an upright manner.

2. The hex wrench as claimed in claim 1, wherein the driving end includes six convex sides, and the end face of the driving end includes six beveled surfaces that are respectively connected with the six convex sides of the driving end.

* * * * *